US010454164B2

(12) United States Patent
Yoshihara et al.

(10) Patent No.: US 10,454,164 B2
(45) Date of Patent: Oct. 22, 2019

(54) ANTENNA DEVICE

(71) Applicant: Hitachi Metals, Ltd., Tokyo (JP)

(72) Inventors: Satoshi Yoshihara, Tokyo (JP); Tomoyuki Ogawa, Tokyo (JP); Seiji Kado, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/779,159

(22) PCT Filed: Nov. 27, 2015

(86) PCT No.: PCT/JP2015/083467

§ 371 (c)(1),
(2) Date: May 25, 2018

(87) PCT Pub. No.: WO2017/090200

PCT Pub. Date: Jun. 1, 2017

(65) Prior Publication Data

US 2018/0358693 A1 Dec. 13, 2018

(51) Int. Cl.
*H01Q 1/38* (2006.01)
*H01Q 1/52* (2006.01)
(Continued)

(52) U.S. Cl.
CPC ..... *H01Q 1/523* (2013.01); *H01Q 9/0407* (2013.01); *H01Q 13/08* (2013.01); *H01Q 21/005* (2013.01); *H01Q 21/06* (2013.01); *H01Q 21/065* (2013.01)

(58) Field of Classification Search
CPC ..... H01Q 1/38; H01Q 1/532; H01Q 13/08; H01Q 21/06; H01Q 9/0407
See application file for complete search history.

(56) References Cited

U.S. PATENT DOCUMENTS 3,295,134 A * 12/1966 Lowe ..... H01Q 3/40 333/101

5,898,405 A * 4/1999 Iwasaki ..... H01Q 1/38 343/700 MS (Continued)

FOREIGN PATENT DOCUMENTS

JP 2000349548 A 12/2000
JP 2007259047 A 10/2007

(Continued)

OTHER PUBLICATIONS

English translation of International Preliminary Report on Patentability dated Jun. 7, 2018 together with the Written Opinion received in related International Application No. PCT/JP2015/083467.

(Continued)

*Primary Examiner* — Huedung X Mancuso
(74) *Attorney, Agent, or Firm* — Scully Scott Murphy & Presser, P.C.

(57) ABSTRACT

An antenna device includes a plurality of antenna element groups including a plurality of antenna elements arranged in a horizontal direction. The plurality of antenna element groups are arranged in multiple stages in a vertical direction. The stage antenna element group includes a first antenna element group in which the antenna element in an even number sequence from the antenna element configuring the antenna element group is arranged at a shifted position to an upper side or a lower side in the vertical direction from the antenna element in an odd number sequence, and a second antenna element group in which the antenna element in the even number sequence from the antenna element configuring the antenna element group is arranged at a shifted position to the other side of the lower side or the upper side in the vertical direction from the antenna element in the odd number sequence.

8 Claims, 8 Drawing Sheets

(51) Int. Cl.

| | |
|---|---|
| ***H01Q 13/08*** | (2006.01) |
| ***H01Q 21/06*** | (2006.01) |
| ***H01Q 9/04*** | (2006.01) |
| ***H01Q 21/00*** | (2006.01) |

(56) References Cited

U.S. PATENT DOCUMENTS

| | | | | |
|---|---|---|---|---|
| 7,129,898 | B1 * | 10/2006 | Chou | H01Q 1/38 343/700 MS |
| 7,317,421 | B2 * | 1/2008 | Liu | H01Q 1/38 343/700 MS |
| 9,425,495 | B2 * | 8/2016 | Walker | H01Q 1/007 |
| 2015/0084832 | A1 | 3/2015 | Al et al. | |

FOREIGN PATENT DOCUMENTS

| | | | |
|---|---|---|---|
| JP | 2007533281 | A | 11/2007 |
| JP | 2015521441 | A | 7/2015 |
| WO | 2005114792 | A1 | 12/2005 |

OTHER PUBLICATIONS

International Search Report dated Dec. 28, 2015 issued in PCT/JP2015/083467.

* cited by examiner

ANTENNA DEVICE

TECHNICAL FIELD

This invention relates to an antenna device.

BACKGROUND ART

An antenna device is known that radiates two beams in the different directions by using a plurality of common antenna elements arranged in a horizontal direction. Such antenna device is generally referred to as a dual beam antenna (or twin beam antenna).

The dual beam antenna is configured to arrange antenna element groups in multiple stages in the vertical direction, which are provided with a plurality of antenna elements arranged in the horizontal direction. The dual beam antenna is configured to radiate a plurality of beams to the different directions by respectively feeding to adjacent antenna elements in each antenna element group along with a predetermined phase difference and a predetermined power difference.

Also, as the dual beam antenna, a dual beam antenna configured to adjust an electric tilt angle is known. The dual beam antenna configured to adjust the electric tilt angel can adjust a radiating direction of the beam in the vertical direction, i.e., the electric tilt angle by feeding to each antenna element group arranged in the vertical direction along with a predetermined phase difference and a predetermined power difference.

Meanwhile, when the antenna elements are arranged in the horizontal direction in line, as the width of the antenna device decreases, it is a problem that a distance between the antenna elements decreases, coupling between the antenna elements increases, and desired radiating property fails to be obtained.

As a solution to the problem, a method is known that arranges an antenna element in an even number sequence at a position shifted to an upper side or a lower side in the vertical direction from an antenna element in an odd number sequence, and arranges the antenna element in zigzag (see e.g., PTL 1). By arranging the antenna elements in zigzag, isolation in each antenna element can increases, and property degradation caused by coupling between the antenna elements can be prevented.

CITATION LIST

Patent Literature

PTL 1: JP 2000/349548 A

SUMMARY OF INVENTION

Technical Problem

However, if the antenna element in the even number sequence is arranged to shift in the vertical direction from the antenna element in the odd number sequence, it is a problem that horizontal-plane directivity of the beam radiated from each antenna element is likely to be affected by power (amplitude) and a phase fed to each antenna element group arranged in the vertical direction (i.e., the designing effect of the directivity in the vertical surface).

As a result, e.g., even if low side lobe horizontal-plane directivity is obtained at an initial electric tilt angle, desired radiating property may not be obtained due to increasing of the side lobe at a specific electric tilt angle when changing the electric tilt angle.

It is an object of the invention to provide an antenna device that can achieve the low side lobe radiating property without depending on the electric tilt angle.

Solution to Problem

To solve the above problem, the present invention provides an antenna device comprising a plurality of antenna element groups comprising a plurality of antenna elements arranged in a horizontal direction and configured to radiate a plurality of beams to different directions by respectively feeding with a predetermined phase difference to adjacent antenna elements, wherein the plurality of antenna element groups are arranged in multiple stages in a vertical direction, wherein at least one or more stage antenna element group from an upper side in the vertical direction comprises a first antenna element group in which the antenna element in an even number sequence from the antenna element configuring the antenna element group is arranged at a shifted position to an upper side or a lower side in the vertical direction from the antenna element in an odd number sequence, and wherein the antenna element group arranged at a lower side in the vertical direction than the first antenna element group comprises a second antenna element group in which the antenna element in the even number sequence from the antenna element configuring the antenna element group is arranged at a shifted position to the other side of the lower side or the upper side in the vertical direction from the antenna element in the odd number sequence.

Advantageous Effects of Invention

According to the invention, an antenna device can be provided that can achieve the low side lobe radiating property without depending on the electric tilt angle.

DESCRIPTION OF EMBODIMENTS

Embodiments

An embodiment of the invention will be described later in reference to accompanying drawings.

Figure 1:
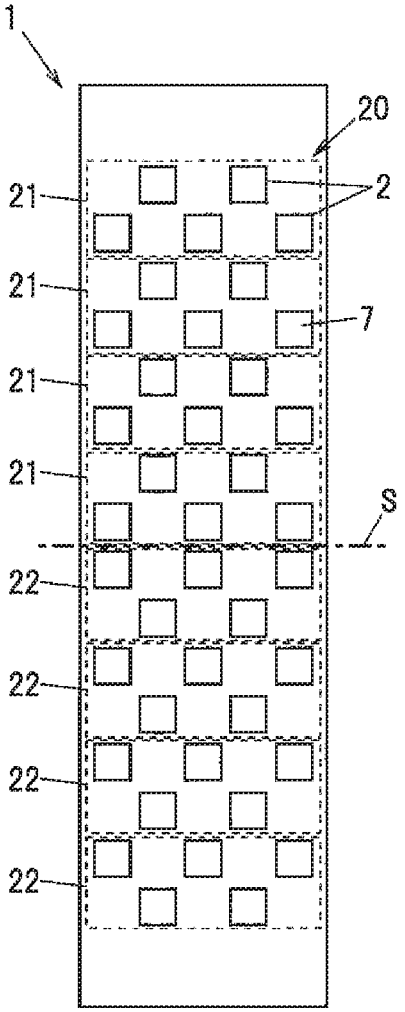
FIG. 1 is a schematic diagram showing an arrangement of an antenna element of an antenna device according to one embodiment of the invention.
Figure 2A:
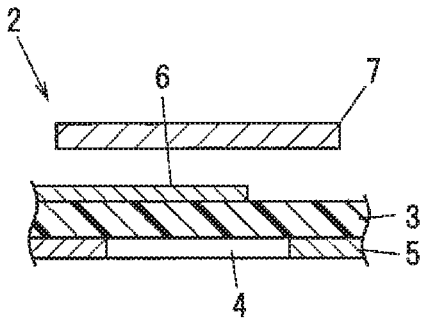
FIG. 2A is a cross sectional view showing a schematic configuration of the antenna element.
Figure 2B:
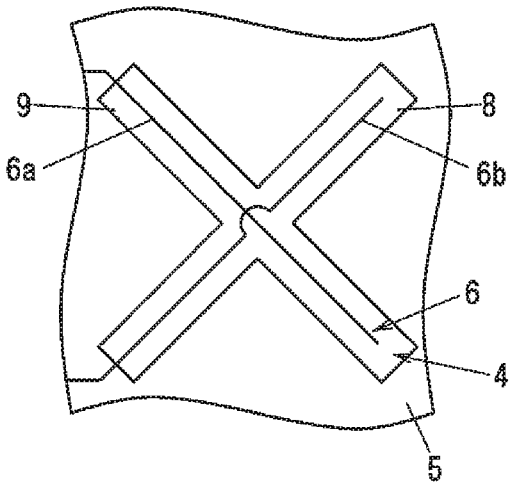
FIG. 2B is an explanation diagram showing a relationship between a slot element and a feed path in the antenna element.

FIG. 1 is a schematic diagram showing an arrangement of an antenna element of an antenna device according to one embodiment of the invention. FIG. 2A is a cross sectional view showing a schematic configuration of the antenna element. FIG. 2B is an explanation diagram showing a relationship between a slot element and a feed path in the antenna element.

As shown in FIG. 1, an antenna device 1 is provided with a plurality of antenna element groups 20 that is provided with a plurality of antenna elements 2 arranged in a horizontal direction (shown right and left direction) and is configured to radiate a plurality of beams in different directions by respectively feeding to adjacent antenna elements 2 with giving a predetermined phase differences. The antenna device 1 is configured to arrange the plurality of antenna elements 20 in multiple stages in the vertical direction (shown vertical direction). The antenna device 1 according to the present embodiment is a dual beam antenna configured to radiate two beams in the different directions.

Herein, as one example, a case that each antenna element group 20 comprises five antenna elements 2, and eight stage antenna element groups 20 are arranged in the vertical direction is shown. However, the number of the antenna elements 2 configuring the antenna element group 20 and the number of stages of the antenna element group 20 are not limited to thereof.

As shown in FIGS. 2A, and 2B, in the present embodiment, each antenna element 2 is composed of a slot-coupled patch antenna. The antenna element 2 is provided with a slot formed layer forming a slot 4 that is composed of a conductive layer formed at a rear surface of a dielectric substrate 3 and passes through the conductive layer, a feed path 6 for feeding formed at a front surface of the dielectric substrate 3, and a rectangular plate shaped radiating element 7 arranged opposite to the front surface of the dielectric substrate 3 with separating.

In the present embodiment, the slot 4 is formed in an X shape. And a +45° slot element 8 that is inclined at 45° to the vertical direction, and a −45° slot element 9 that is inclined at −45° to the vertical direction.

The feed path 6 is provided with a first feed path 6*a* feeding to the +45° slot element 8 and a second feed path 6*b* feeding to the −45° slot element 9.

The first feed path 6*a* is formed so as to cross the +45° slot element 8 in a short axis direction in a plan view at a center position in a long axis direction of the +45° slot element 8. When feeding to the first feed path 6*a*, electric wave is radiated by exciting the +45° slot element 8 and coupled with the radiating element 7. The electric wave radiated at this time is a polarized wave inclined at 45° to the vertical direction.

Also, the second feed path 6*b* is formed so as to cross the −45° slot element 9 in the short axis direction in a plan view at a center position in the long axis direction of the −45° slot element 9. When feeding to the second feed path 6*b*, electric wave is radiated by exciting the −45° slot element 9 and coupled with the radiating element 7. The electric wave radiated at this time is a polarized wave inclined at −45° to the vertical direction.

Figure 3A:
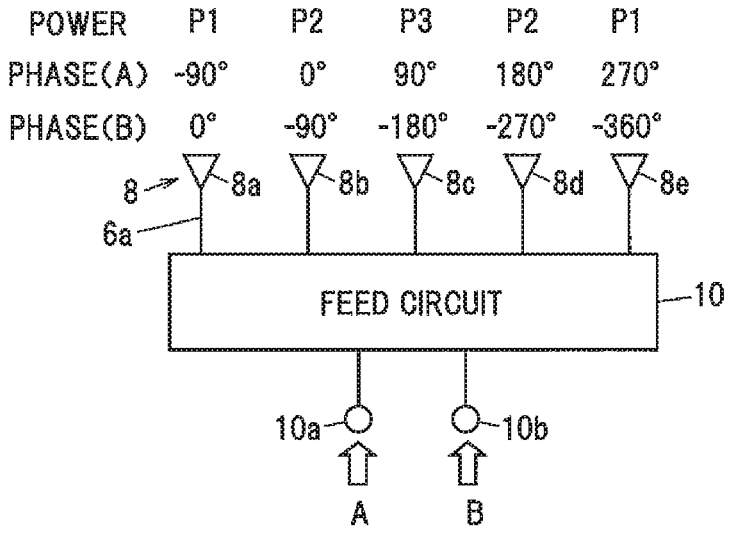
FIG. 3A is an explanation diagram showing power and a phase fed to each antenna element.

As shown in FIG. 3A, feed circuit 10 adjusting power and a phase fed to each +45° slot element 8 is connected to five +45° slot elements 8 configuring each antenna element group 2. Meanwhile, as not shown, such feed circuit is also connected to five −45° slot elements 9 configuring each antenna element group 2.

The feed circuit 10 is provided with two feed terminals 10*a*, 10*b* into which two feed signals A, B are respectively input. The feed circuit 10 is configured to distribute the feed signals A, B input from the feed terminals 10*a*, 10*b* and feed to each +45° slot element 8. In such case, +45° slot elements 8*a* to 8*e* are arranged in sequence from the left side to the right side shown in FIGS. Each +45° slot element 8*a* to 8*e* is arranged in the horizontal direction while separated.

The feed circuit 10 is configured to feed such that the power P1 fed to the +45° slot elements 8*a*, 8*e* arranged at ends (columns 1, 5) in the horizontal direction are equal, and the power P2 fed to the +45° slot elements 8*b*, 8*d* arranged at second columns from ends (columns 2, 4) in the horizontal direction are equal. Furthermore, the feed circuit 10 is configured to feed so as to satisfy P3>P2>P1 where P3 is the power fed to the +45° slot element 8*c* arranged at the center (column 3) in the horizontal direction.

In other words, the feed circuit 10 is configured to increase feed power as the antenna element 2 is arranged at the center, and decrease the feed power as the antenna element 2 is arranged at the end. Thus, unnecessary radiation can be controlled, and side lobe can be controlled.

Figure 3B:
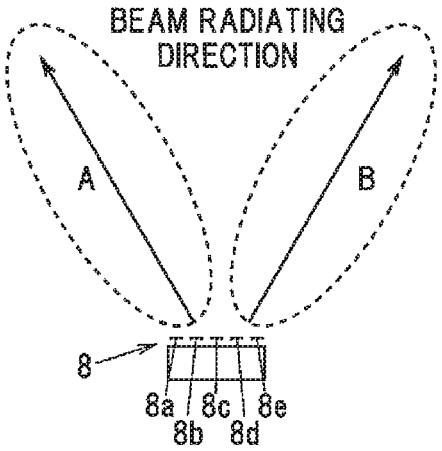
FIG. 3B is an explanation diagram showing a beam radiating direction when entering feed signal.

Furthermore, the feed circuit 10 is configured to adjust the phase of the feed signal fed to each +45° slot element 8*b*, 8*d* so as to increase phase by 90° in sequence from the left side to the right side shown in FIGS when the feed signal A is input from the feed terminal 10*a*. Thus, as shown in FIG. 3B, the beam is radiated to shown left side when the feed signal A is input.

Furthermore, the feed circuit 10 is configured to adjust the phase of the feed signal fed to each +45° slot element 8 so as to decrease phase by 90° in sequence from the left side to the right side shown in FIGS when the feed signal B is input from the feed terminal 10*b*. Thus, as shown in FIG. 3B, the beam is radiated to shown right side when the feed signal B is input.

Meanwhile, in the present embodiment, specific structure of the feed circuit 10 is not limited to thereof. Furthermore, phase difference between adjacent antenna elements 2 (slot elements 8, 9) is suitably set without being limited at 90°.

A radiating direction of the beam can be adjusted by distance between the antenna elements 2 in the horizontal direction. For example, in applied to a six sector base station that defines six sectors by dividing communication area by 60°, the space between the antenna elements 2 should be adjusted such that angle in the horizontal direction between radiating directions of two beams output in fed from both feed terminals 10*a*, 10*b* is approximately 60°.

As not shown, an upstream feed circuit that distributes a feed signal to each antenna element group 20 arranged in the vertical direction and adjusts power and a phase of the feed signal fed to each antenna element group 20 is provided at an upstream side of each feed circuit 10. The radiating direction of the beam in the vertical direction, i.e., an electric tilt angle can be adjusted by adjusting the power and the phase of the feed signal fed to each antenna element group 20 in the upstream feed circuit.

Returning to FIG. 1, in the antenna device 1 according to the present embodiment, at least one or more stage antenna element group 20 from an upper side in the vertical direction is composed of a first antenna element group 21 in which the antenna element 2 in an even number sequence from the antenna element 2 configuring the antenna element group 20 is arranged at a shifted position to the upper side in the vertical direction from an antenna elements 2 in an odd number. And the antenna element group 20 arranged at a lower side in the vertical direction from the first antenna element group 21 is composed of a second antenna element group 22 in which the antenna element 2 in the even number sequence from the antenna element 2 configuring the antenna element group 20 is arranged at a shifted to the lower side in the vertical direction from the antenna element 2 in the odd number sequence.

The antenna element 2 configuring each first antenna element group 21 is arranged in zigzag such that the antenna element 2 is distributed uniformly as a whole. Also, the antenna element 2 configuring each second antenna element group 22 is arranged in zigzag such that the antenna element 2 is distributed uniformly as a whole.

In the first antenna element group 21 and the second antenna element group 22, the distance in the vertical direction between the antenna element 2 in the even number sequence and the antenna element 2 in the odd number sequence (the distance shifted in the vertical direction) is equal. The first antenna element group 21 is only different from the second antenna element group 22 in a shifting direction of the antenna element 2 in the even number sequence. The arrangement interval between the antenna elements 2 etc., is in same.

In the present embodiment, although the antenna element 2 in the even number sequence and the antenna element 2 in the odd number sequence are arranged with separated in the vertical direction so as not to overlap in the horizontal direction, the antenna element 2 may be arranged such that the antenna element 2 in the even number sequence overlaps the antenna element 2 in the odd number sequence in the horizontal direction when enough isolation between the adjacent antenna elements 2 is ensured. In such case, the antenna element 2 in the even number sequence in one of the antenna element groups 2 and the antenna element 2 in the other antenna element group 20, which are adjoined in the vertical direction, are arranged to overlap in the horizontal direction such that the antenna elements 2 is distributed uniformly.

The number of the first antenna element group 21 is desirable to be equal to the number of the second antenna element group 22. In the present embodiment, since the antenna element group 20 has eight stages, i.e., even number stages, four antenna element groups 20 from upper side in the vertical direction are the first antenna element groups 21, and four antenna element groups 20 from lower side in the vertical direction are the second antenna element group 22.

In the present embodiment, the antenna element 2 configuring the first antenna element group 21 and the antenna element 2 configuring the second antenna element group 22 are arranged so as to be vertical asymmetry. In FIG. 1, a symmetrical axis is described as the mark S. In the present embodiment, since the number of the first antenna element groups 21 is equal to the number of the second antenna element groups 22, the symmetrical axis S is located at the center portion of the antenna device 1 in the vertical direction.

For the antenna device 1, the radiating property of one of the beams in a horizontal surface when the electric tilt angel changes will be described in FIG. 4. Here, an initial electric tilt angle (initial tilt angle) is set at 5°, and the electric tilt angle changes to ±5° from the initial tilt angle. Frequency of the feed signal is set at 1940 MHz. The distance in the vertical direction between the antenna elements 2 in each column is set at 74 mm. The distance in the horizontal direction between the antenna elements 2 of both antenna elements 2 in the odd number sequence or both antenna elements 2 in the even number sequence is set as 70 mm.

Figure 4:
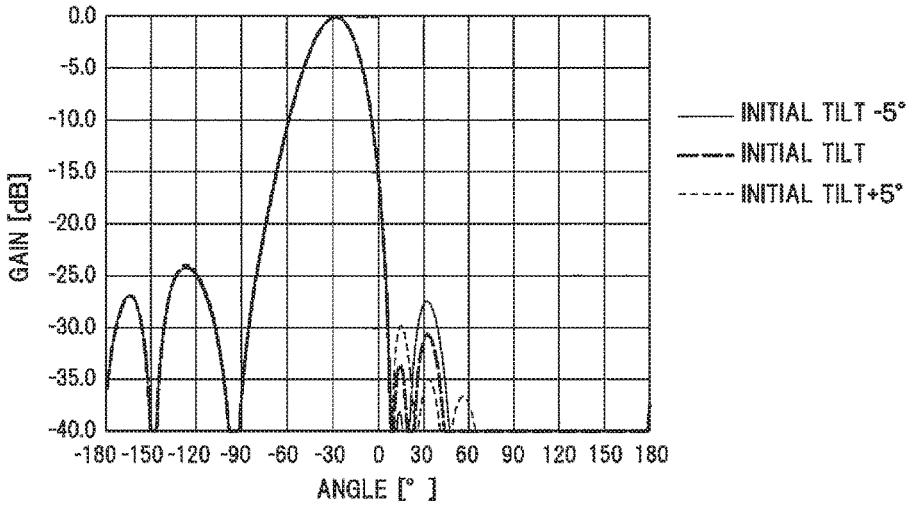
FIG. 4 is a graph chart showing radiating property in a horizontal surface of one of beams when changing an electric tilt angle in the antenna device in FIG. 1.

As shown in FIG. 4, for the antenna device 1, side lobe levels in every electric tilt angles are approximately not more than −25 dB. Thus, it shows that the low side lobe horizontal-plane directivity is obtained.

Figure 5:
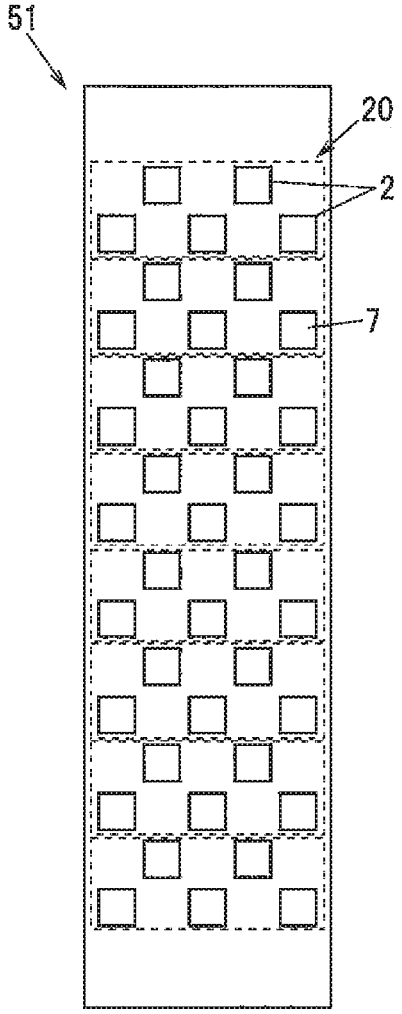
FIG. 5 is a schematic diagram showing an arrangement of a conventional antenna device.

For comparison, the radiating property in a conventional antenna device 51 arranging the antenna elements 2 in zigzag as shown in FIG. 5 in same condition with FIG. 4 will be described in FIG. 6. Meanwhile, the antenna device 51 shown in FIG. 5 is an antenna device that changes all the antenna element groups 20 in the antenna device 1 in FIG. 1 into the first antenna element groups 21.

Figure 6:
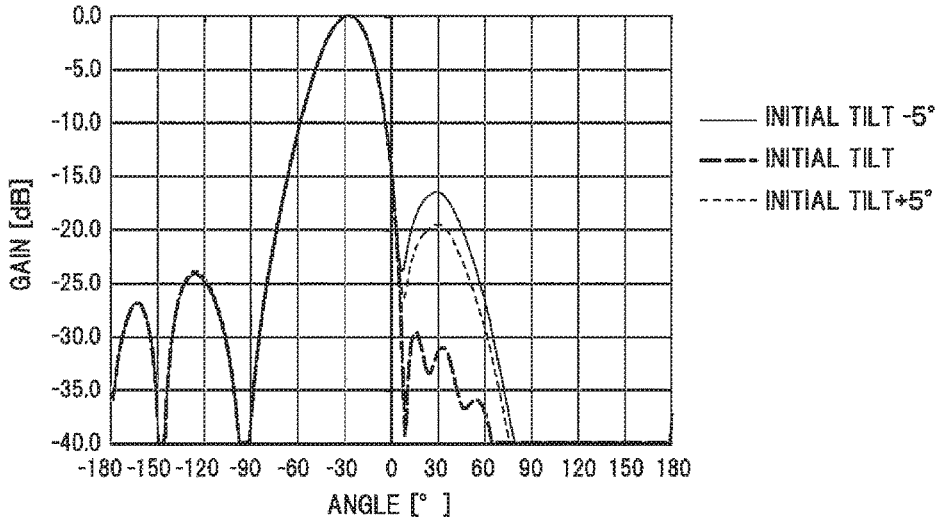
FIG. 6 is a graph chart showing radiating property in a horizontal surface of one of beams when changing an electric tilt angle in the antenna device in FIG. 5.

As shown in FIG. 6, FIG. 6 shows that the side lobe level is high when the electric tilt angel changes from the initial tilt angle even when the conventional antenna device 51 is designed such that the side lobe level at the initial tilt angle is not more than −25 dB.

For the conventional antenna device 51, since the antenna element 2 in the odd number sequence is located at a shifted position in the vertical direction (in such case, the upper side) to the antenna element 2 in the even number sequence in the entire antenna device 51, it is considered that the distributions of the antenna element 2 in the odd number sequence and the antenna element 2 in the even number sequence are shifted in the vertical direction and symmetry in the vertical direction highly collapses.

For the antenna device 1 according to the present embodiment, since a shifting direction in which the antenna element 2 in the odd number sequence is shifted to the antenna element 2 in the even number sequence in the first antenna element group 21 arranged at the upper side in the vertical direction is opposite to a shifting direction in which the antenna element 2 in the odd number sequence is shifted to the antenna element 2 in the even number sequence in the second antenna element group 22 arranged at the lower side in the vertical direction, shift in the vertical direction of the distribution between the antenna element 2 in the odd number sequence and the antenna element 2 in the even number sequence can be improved. And the antenna device 1 according to the present embodiment is hard to be affected by the power or the phase fed to each antenna element group 20 arranged in the vertical direction (i.e., the design effect of the directivity in the vertical surface). As a result, it is considered that the low side lobe radiating property can be achieved without depending on the electric tilt angle.

In the conventional antenna device 51, difference in sum of phases between the antenna element 2 in the odd number sequence and the antenna element 2 in the even number sequence increases at approximately 10° when the electric tilt angle is set at −5° as the initial tilt angle. Meanwhile, in the antenna device 1 according to the present embodiment, it is confirmed that distance in sum of phases between the antenna element 2 in the odd number sequence and the antenna element 2 in the even number sequence can be small that is up to approximately 1.2°. That is, compared to the conventional antenna device 51, for the antenna device 1, the phase difference of the antenna element 2 in each antenna element group 20 can be closer to the predetermined phase difference without depending on the electric tilt angle. And the low side lobe radiating property can be achieved.

Meanwhile, e.g., the same effect can be obtained by alternately arranging the first antenna element group 21 and the second antenna element group 22 in the vertical direction. However, coupling between the antenna elements 2 becomes stronger and the desirable property may not be obtained since the antenna element 2 in the even number sequence and the antenna element 2 in the odd number sequence are adjacently arranged in the vertical direction. Thus, a portion where the first antenna element group 21 adjoins the second antenna element group 22 is desirable to be small as possible. As with the present embodiment, it is desirable to be configured to arrange the first antenna element group 21 at the upper side in the vertical direction and arrange the second antenna element group 21 at the lower side in the vertical direction.

Variations

In the present embodiment, although it is configured to shift the antenna element 2 in the even number sequence to the upper side in the vertical direction from the antenna element 2 in the odd number sequence in the first antenna element group 21, and shift the antenna element 2 in the even number sequence to the lower side in the vertical direction from the antenna element 2 in the odd number sequence in the second antenna element group 22, the shift directions of the antenna element 2 in the even number sequence and the antenna element 2 in the odd number sequence may be opposite in both the antenna element groups 21, 22.

Figure 7:
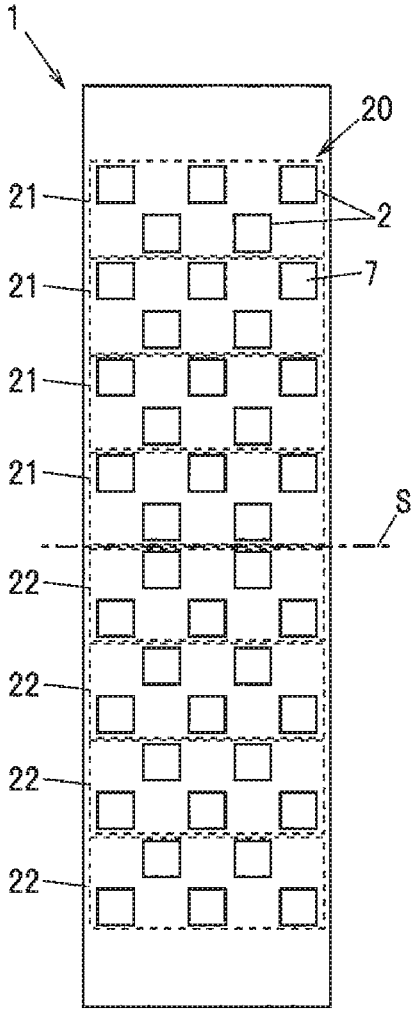
FIG. 7 is a schematic diagram showing an arrangement of an antenna device according to a variation of the invention.

Specifically, as shown in FIG. 7, it may be configured to shift the antenna element 2 in the even number sequence to the lower side in the vertical direction from the antenna element 2 in the odd number sequence in the first antenna element group 21, and shift the antenna element 2 in the even number sequence to the upper side in the vertical direction from the antenna element 2 in the odd number sequence in the second antenna element group 22.

Moreover, in the present embodiment, although the number of the first antenna element group 21 is in same with the number of the second antenna element group 22, the number of the first antenna element group 21 may be different from the number of the second antenna element group 22. Even when both the antenna element groups 21, 22 have at least one stage, effect to prevent the side lobe compared to the conventional antenna device 51 can be obtained.

Figure 8:
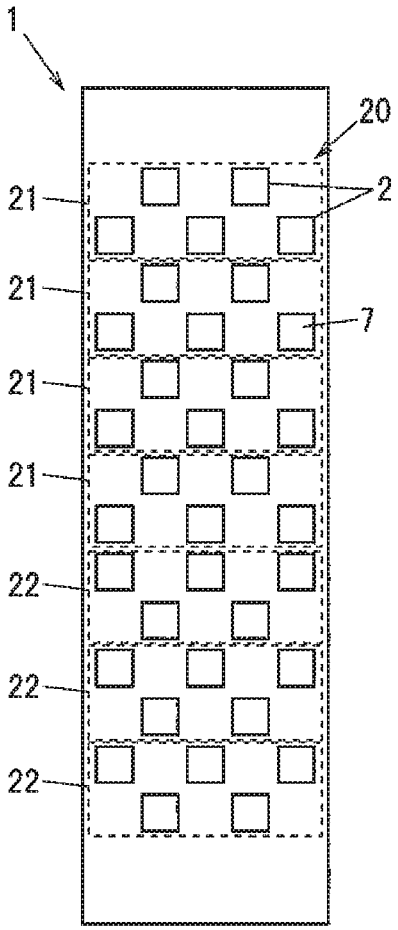
FIG. 8 is a schematic diagram showing an arrangement of an antenna device according to a variation of the invention.

For example, as shown in FIG. 8, when the stages of the antenna element group 20 is odd (in such case, seven stages), the numbers of both the antenna element groups 21, 22 are necessary different. Meanwhile, since inhibition effect in the side lobe is mostly effective when the numbers of both the antenna element groups 21, 22 are equal, the difference between the numbers of both the antenna element groups 21, 22 is desirable to be as small as possible.

Thus, when the stages of the antenna element group 20 is odd, the number of the first antenna element group 21 is desirable to be $(n+1)/2$ or $(n-1)/2$ as the stage number of the antenna element group 20 is n. In FIG. 8, although the case that the stage number of the first antenna element group 21 is four and the stage number of the second antenna element group 22 is three is described, the stage number of the first antenna element group 21 may be three and the stage number of the second antenna element groups 22 may be four.

Effects of the Embodiments

As described above, for the antenna device 1 according to the present embodiment, at least one or more stage antenna element group 20 from the upper side in the vertical direction is composed of the first antenna element group 21 in which the antenna element 2 in the even number sequence from the antenna element 2 configuring the antenna element group 20 is arranged at the shifted position to an upper side or a lower side in the vertical direction from the antenna element 2 in an odd number sequence, and the antenna element group 20 arranged at the lower side in the vertical direction from the first antenna element group 21 is composed of the second antenna element group 22 in which the antenna element 2 in the even number sequence from the antenna element 2 configuring the antenna element group 20 is arranged at the shifted position to the other side of the lower side or the upper side in the vertical direction from the antenna element 2 in the odd number sequence.

As such configuration, the antenna device 1 that improves the shift in the vertical direction of the distribution between the antenna element 2 in the odd number sequence and the antenna element 2 in the even number sequence while width of the antenna device 1 is minimized and the isolation of each antenna element 2 increases by arranging the antenna element 2 in approximately zigzag, and can achieve the low side lobe radiating property without depending on the electric tilt angle. In other words, an electric tilt type dual beam antenna that can obtain the low side lobe radiating property at any electric tilt angle can be achieved.

Summary of the Embodiments

Next, technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] An antenna device (1), comprising a plurality of antenna element groups (20) comprising a plurality of antenna elements (2) arranged in a horizontal direction and configured to radiate a plurality of beams to different directions by respectively feeding with a predetermined phase difference to adjacent antenna elements (2), wherein the plurality of antenna element groups (20) are arranged in multiple stages in a vertical direction, wherein at least one or more stage antenna element group (20) from an upper side in the vertical direction comprises a first antenna element group (21) in which the antenna element (2) in an even number sequence from the antenna element (2) configuring the antenna element group (20) is arranged at a shifted position to an upper side or a lower side in the vertical direction from the antenna element (2) in an odd number sequence, and wherein the antenna element group (20) arranged at a lower side in the vertical direction than the first antenna element group (21) comprises a second antenna element group (22) in which the antenna element (2) in the even number sequence from the antenna element (2) configuring the antenna element group (20) is arranged at a shifted position to the other side of the lower side or the upper side in the vertical direction from the antenna element (2) in the odd number sequence.

[2] The antenna device (1) according to [1], wherein the antenna element (2) configuring each first antenna element group (21) is arranged in zigzag, and wherein the antenna element (2) configuring each second antenna element group (22) is arranged in zigzag.

[3] The antenna device (1) according to [1] or [2], comprising even stage antenna element groups (20), and wherein the number of the first antenna element group (21) is equal to the number of the second antenna element group (22).

[4] The antenna device (1) according to [3], wherein the antenna element (2) configuring the first antenna element group (21) and the antenna element (2) configuring the second antenna element group (22) are arranged symmetrically in the vertical direction.

[5] The antenna device (1) according to [1] or [2], comprising an odd stage antenna element group (20), wherein the number of the first antenna element group (21) is (n+1)/2, or (n−2)/2 where n is a stage number of the antenna element group (20).

Although the embodiments of the invention have been described, the invention according to claims is not to be limited to the above-mentioned embodiment. It should be noted that all combinations of the features described in the embodiments are not necessary to solve the problem of the invention.

Further, the invention can be appropriately modified and implemented without departing from the gist thereof.

For example, in the described-above embodiment, although the case that the slot-coupled patch antenna is used as the antenna element 2 is described, specific shape etc., of the antenna element 2 is not limited to thereof. For example, the antenna element 2 may be a dipole antenna.

Moreover, in the described-above embodiment, the case that the antenna device 1 is a dual beam antenna configured to radiate two beams to the different directions is described, it is not limited to thereof. The antenna device 1 may be a multi-beam antenna configured to respectively radiate not less than two beams to the different directions.

REFERENCE SIGNS LIST

1 ANTENNA DEVICE
2 ANTENNA ELEMENT
20 ANTENNA ELEMENT GROUP
21 FIRST ANTENNA ELEMENT GROUP
22 SECOND ANTENNA ELEMENT GROUP

The invention claimed is:

1. An antenna device, comprising a plurality of antenna element groups comprising a plurality of antenna elements arranged in a horizontal direction and configured to radiate a plurality of beams to different directions by respectively feeding with a predetermined phase difference to adjacent antenna elements, wherein the plurality of antenna element groups are arranged in multiple stages in a vertical direction, wherein at least one or more stage antenna element group from an upper side in the vertical direction comprises a first antenna element group in which the antenna element in an even number sequence from the antenna element configuring the antenna element group is arranged at a shifted position to an upper side or a lower side in the vertical direction from the antenna element in an odd number sequence, and wherein the antenna element group arranged at a lower side in the vertical direction from the first antenna element group comprises a second antenna element group in which the antenna element in the even number sequence from the antenna element configuring the antenna element group is arranged at a shifted position to the other side of the lower side or the upper side in the vertical direction from the antenna element in the odd number sequence.

2. The antenna device according to claim 1, wherein the antenna element configuring each first antenna element group is arranged in zigzag, and wherein the antenna element configuring each second antenna element group is arranged in zigzag.

3. The antenna device according to claim 1, comprising even stage antenna element groups, and wherein the number of the first antenna element group is equal to the number of the second antenna element group.

4. The antenna device according to claim 3, wherein the antenna element configuring the first antenna element group and the antenna element configuring the second antenna element group are arranged symmetrically in the vertical direction.

5. The antenna device according to claim 1, comprising an odd stage antenna element group, wherein the number of the first antenna element group is (n+1)/2, or (n−2)/2 where n is a stage number of the antenna element group.

6. The antenna device according to claim 2, comprising even stage antenna element groups, and wherein the number of the first antenna element group is equal to the number of the second antenna element group.

7. The antenna device according to claim 6, wherein the antenna element configuring the first antenna element group and the antenna element configuring the second antenna element group are arranged symmetrically in the vertical direction.

8. The antenna device according to claim 2, comprising an odd stage antenna element group, wherein the number of the first antenna element group is (n+1)/2, or (n−2)/2 where n is a stage number of the antenna element group.

* * * * *